US006546732B1

(12) United States Patent
Young et al.

(10) Patent No.: US 6,546,732 B1
(45) Date of Patent: Apr. 15, 2003

(54) METHODS AND APPARATUS FOR COOLING GAS TURBINE ENGINE COMBUSTORS

(75) Inventors: Craig Douglas Young, Maineville, OH (US); Paul Edward Sabla, Cincinnati, OH (US); Steven Clayton Vise, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,205

(22) Filed: Apr. 27, 2001

(51) Int. Cl.[7] ..... F23R 3/06; F23R 3/14
(52) U.S. Cl. ..... 60/772; 60/740; 60/748
(58) Field of Search ..... 60/740, 737, 748, 60/756, 751, 752, 772

(56) References Cited

U.S. PATENT DOCUMENTS 2,699,648 A * 1/1955 Berkey ..... 60/752
4,162,611 A * 7/1979 Caruel et al. ..... 60/748
4,686,823 A * 8/1987 Coburn et al. ..... 60/740
4,766,722 A * 8/1988 Bayle-Laboure et al. ..... 60/752
4,870,818 A * 10/1989 Suliga ..... 60/740
5,142,871 A * 9/1992 Lampes et al. ..... 60/756
5,154,060 A 10/1992 Walker et al.
5,279,127 A 1/1994 Napoli
5,323,604 A 6/1994 Ekstedt et al.
5,329,761 A 7/1994 Ablett et al.
5,479,772 A * 1/1996 Halila ..... 60/747
5,894,732 A * 4/1999 Kwan ..... 60/748
5,941,076 A * 8/1999 Sandelis ..... 60/752

* cited by examiner

*Primary Examiner*—Ted Kim
(74) *Attorney, Agent, or Firm*—Rodney M. Young; Armstrong Teasdale LLP

(57) ABSTRACT

A one-piece deflector-flare cone assembly for a gas turbine engine combustor that facilitates extending a useful life of the combustor in a cost-effective and reliable manner is described. The one-piece assembly includes a deflector portion and a flare cone portion. The deflector portion includes an integral opening that extends through the deflector portion for receiving cooling fluid therein. The cooling opening extends circumferentially within the deflector portion. Cooling fluid discharged from the cooling opening is used for film cooling a portion of the deflector portion to facilitate reducing an operating temperature and extending a useful life of the combustor.

20 Claims, 3 Drawing Sheets

METHODS AND APPARATUS FOR COOLING GAS TURBINE ENGINE COMBUSTORS

BACKGROUND OF THE INVENTION

This application relates generally to gas turbine engines and, more particularly, to combustors for gas turbine engine.

Combustors are used to ignite fuel and air mixtures in gas turbine engines. Known combustors include at least one dome attached to a combustor liner that defines a combustion zone. Fuel injectors are attached to the combustor in flow communication with the dome and supply fuel to the combustion zone. Fuel enters the combustor through a dome assembly attached to a spectacle or dome plate.

The dome assembly includes an air swirler secured to the dome plate, and radially inward from a flare cone. The flare cone is divergent and extends radially outward from the air swirler to facilitate mixing the air and fuel, and spreading the mixture radially outwardly into the combustion zone. A divergent deflector extends circumferentially around the flare cone and radially outward from the flare cone. The deflector prevents hot combustion gases produced within the combustion zone from impinging upon the dome plate.

During operation, fuel discharging to the combustion zone combines with air through the air swirler and may form a film along the flare cone and the deflector. This fuel mixture may combust resulting in high gas temperatures. Prolonged exposure to the increased temperatures increases a rate of oxidation formation on the flare cone, and may result in melting or failure of the flare cone.

To facilitate reducing operating temperatures of the flare cone, at least some known combustor dome assemblies supply cooling air for convection cooling of the dome assembly through a gap extending partially circumferentially between the flare cone and the deflector. Such dome assemblies are complex, multi-piece assemblies that require multiple brazing operations to fabricate and assemble. In addition, during use the cooling air may mix with the combustion gases and adversely effect combustor emissions.

Because the multi-piece combustor dome assemblies are also complex to disassemble for maintenance purposes, at least some other known combustor dome assemblies include one-piece assemblies. Although these dome assemblies facilitate reducing combustor emissions, such assemblies do not supply cooling air to the dome assemblies, and as such, may adversely impact deflector and flare cone durability.

BRIEF SUMMARY OF THE INVENTION

In an exemplary embodiment, a one-piece deflector-flare cone assembly for a gas turbine engine combustor facilitates extending a useful life of the combustor in a cost-effective and reliable manner without sacrificing combustor performance. The cone assembly includes an integral deflector portion and a flare cone portion. The deflector portion includes an integral opening that extends circumferentially through the deflector portion for receiving cooling fluid therein. The deflector opening is also circumferentially in flow communication with the flare cone portion.

During operation, cooling fluid supplied through the deflector opening is used for film cooling a portion of the deflector. The film cooling facilitates reducing an operating temperature of the deflector, and thus facilitates extending a useful life of the deflector. Furthermore, because the operating temperature of the deflector is reduced, a rate of oxidation formation on the deflector is also reduced. Additionally, cooling fluid discharged through the opening is also used for impingement cooling the flare cone portion. The deflector facilitates reducing mixing between the cooling fluid and the combustion gases. As a result, the deflector opening facilitates reducing combustor operating temperatures to improve combustor performance and extend a useful life of the combustor, without sacrificing combustor performance.

DETAILED DESCRIPTION OF THE INVENTION

Figure 1:
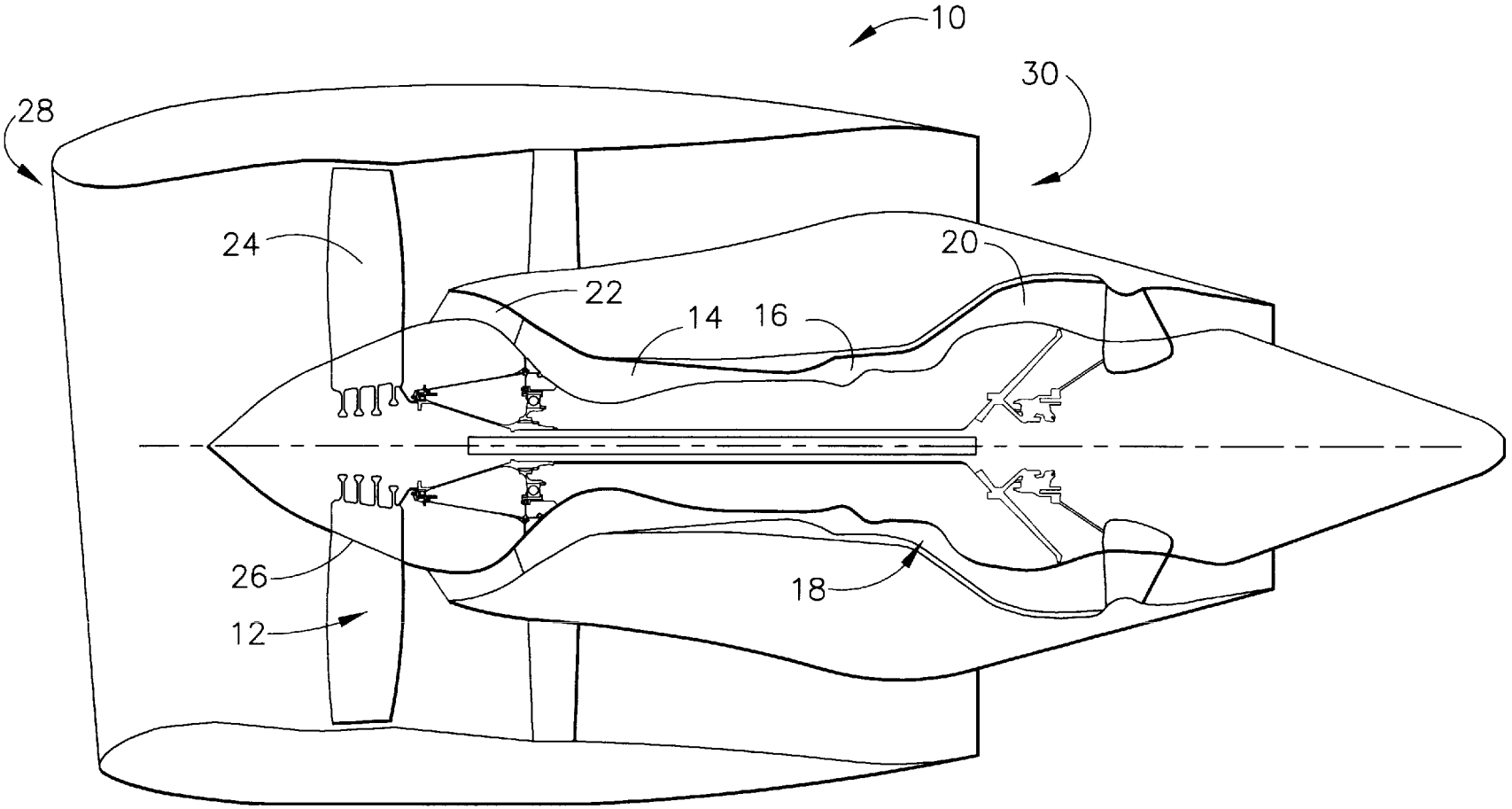
FIG. 1 is a schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, gas turbine engine 10 is a GE90 engine commercially available from General Electric Company, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
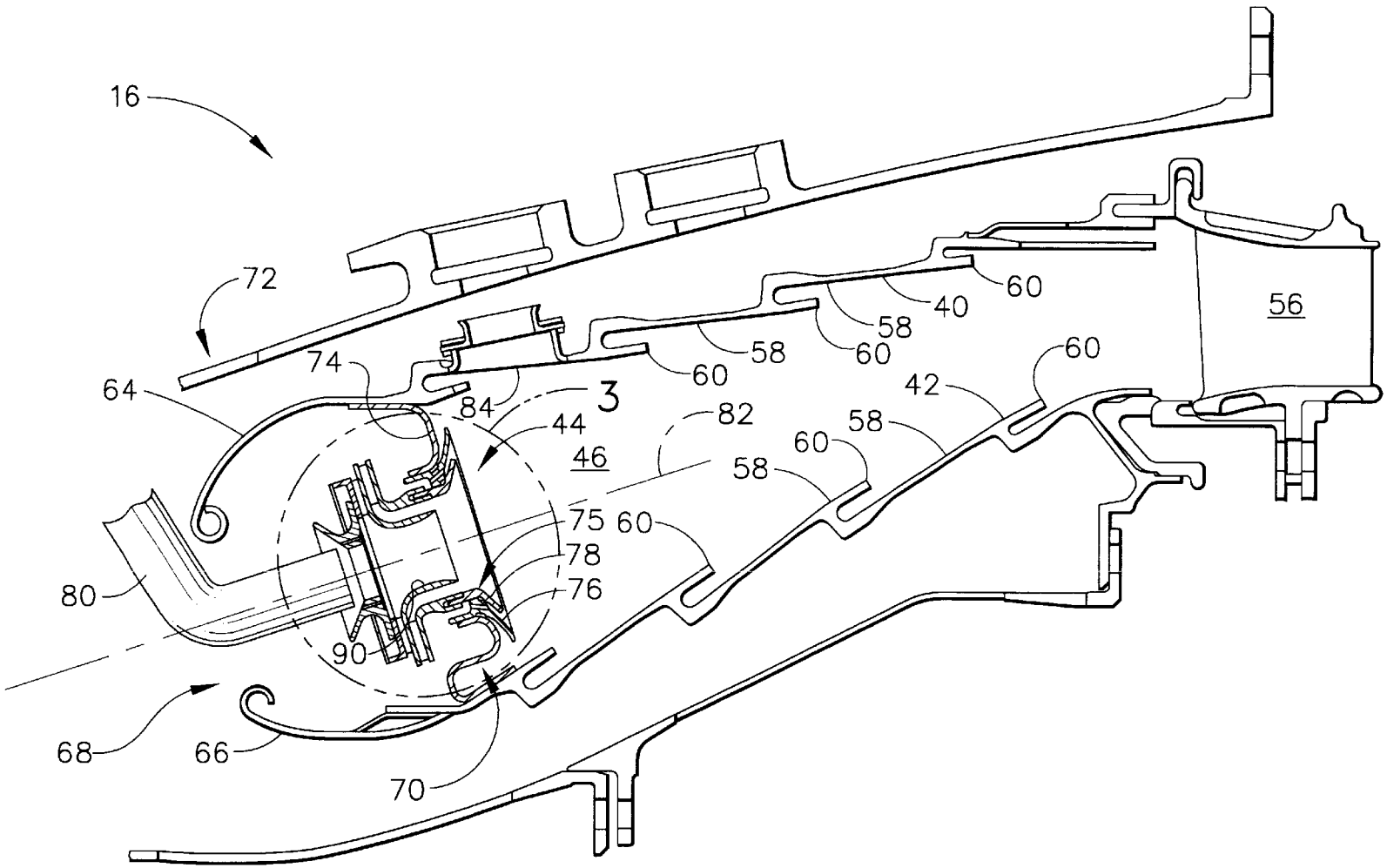
FIG. 2 is a cross-sectional view of a combustor used with the gas turbine engine shown in FIG. 1.
Figure 3:
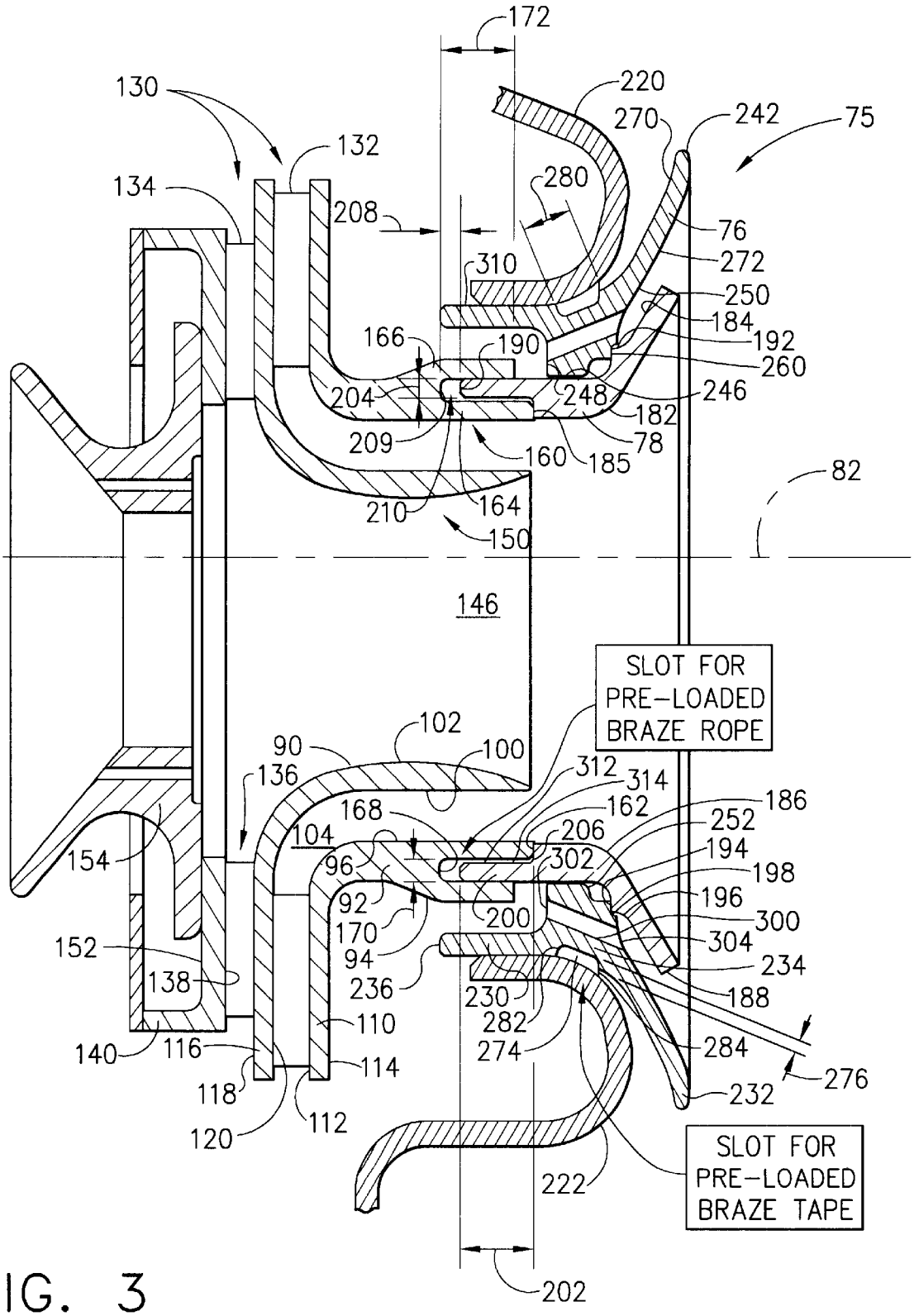
FIG. 3 is an enlarged view of the combustor shown in Figure taken along area 3.

FIG. 2 is a cross-sectional view of combustor 16 used in gas turbine engine 10 (shown in FIG. 1). FIG. 3 is an enlarged view of combustor 16 taken along area 3 shown in FIG. 2. Combustor 16 includes an annular outer liner 40, an annular inner liner 42, and a domed end 44 extending between outer and inner liners 40 and 42, respectively. Outer liner 40 and inner liner 42 define a combustion chamber 46.

Combustion chamber 46 is generally annular in shape and is disposed between liners 40 and 42. Outer and inner liners 40 and 42 extend to a turbine nozzle 56 disposed downstream from combustor domed end 44. In the exemplary embodiment, outer and inner liners 40 and 42 each include a plurality of panels 58 which include a series of steps 60, each of which forms a distinct portion of combustor liners 40 and 42.

Outer liner 40 and inner liner 42 each include a cowl 64 and 66, respectively. Inner cowl 66 and outer cowl 64 are upstream from panels 58 and define an opening 68. More specifically, outer and inner liner panels 58 are connected serially and extend downstream from cowls 66 and 64, respectively.

In the exemplary embodiment, combustor domed end 44 includes an annular dome assembly 70 arranged in a single annular configuration. In another embodiment, combustor domed end 44 includes a dome assembly 70 arranged in a double annular configuration. In a further embodiment, combustor domed end 44 includes a dome assembly 70 arranged in a triple annular configuration. Combustor dome assembly 70 provides structural support to a forward end 72 of combustor 16, and each includes a dome plate or spectacle plate 74 and an integral deflector-flare cone assembly 75 having a deflector portion 76 and a flare cone portion 78.

Combustor 16 is supplied fuel via a fuel injector 80 connected to a fuel source (not shown) and extending through combustor domed end 44. More specifically, fuel injector 80 extends through dome assembly 70 and discharges fuel in a direction (not shown) that is substantially concentric with respect to a combustor center longitudinal axis of symmetry 82. Combustor 16 also includes a fuel igniter 84 that extends into combustor 16 downstream from fuel injector 80.

Combustor 16 also includes an annular air swirler 90 having an annular exit cone 92 disposed symmetrically about center longitudinal axis of symmetry 82. Exit cone 92 includes a radially outer surface 94 and a radially inwardly facing flow surface 96. Annular air swirler 90 includes a radially outer surface 100 and a radially inwardly facing flow surface 102. Exit cone flow surface 96 and air swirler flow surface 102 define an aft venturi channel 104 used for channeling a portion of air therethrough and downstream.

More specifically, exit cone 92 includes an integrally formed outwardly extending radial flange portion 110. Exit cone flange portion 110 includes an upstream surface 112 that extends from exit cone flow surface 96, and a substantially parallel downstream surface 114 that is generally perpendicular to exit cone flow surface 96. Air swirler 90 includes a integrally formed outwardly extending radial flange portion 116 that includes an upstream surface 118 and a substantially parallel downstream surface 120 that extends from air swirler flow surface 102. Air swirler flange surfaces 118 and 120 are substantially parallel to exit cone flange surfaces 112 and 114, and are substantially perpendicular to air swirler flow surface 102.

Air swirler 90 also includes a plurality of circumferentially spaced swirl vanes 130. More specifically, a plurality of aft swirl vanes 132 are slidably coupled to exit cone flange portion 110 within aft venturi channel 104. A plurality of forward swirl vanes 134 are slidably coupled to air swirler flange portion 116 within a forward venturi channel 136. Forward venturi channel 136 is defined between air swirler flange portion 116 and a downstream side 138 of an annular support plate 140. Forward venturi channel 136 is substantially parallel to aft venturi channel 104 and extends radially inward towards center longitudinal axis of symmetry 82.

Air swirler flange portion surfaces 118 and 120 are substantially planar and air swirler flow surface 102 is substantially convex and defines a forward venturi 146. Forward venturi 146 has a forward throat 150 which defines a minimum flow area. Forward venturi 146 is radially inward from aft venturi channel 104 and is separated therefrom with air swirler 90.

Support plate 140 is concentrically aligned with respect to combustor center longitudinal axis of symmetry 82, and includes an upstream side 152 coupled to a tubular ferrule 154. Fuel injector 80 is slidably disposed within ferrule 154 to accommodate axial and radial thermal differential movement.

A wishbone joint 160 is integrally formed within exit cone 92 at an aft end 162 of exit cone 92. More specifically, wishbone joint 160 includes a radially inner arm 164, a radially outer arm 166, and an attachment slot 168 defined therebetween. Radially inner arm 164 extends between exit cone flow surface 96 and slot 168. Radially outer arm 166 is substantially parallel to inner arm 164 and extends between slot 168 and exit cone downstream surface 114. Attachment slot 168 has a width 170 and is substantially parallel to exit cone flow surface 96. Additionally, slot 168 extends into exit cone 92 for a depth 172 measured from exit cone aft end 162.

Deflector-flare cone assembly 75 couples to air swirler 90. More specifically, flare cone portion 78 couples to exit cone 92 and extends downstream from exit cone 92. More specifically, flare cone portion 78 includes a radially inner flow surface 182 and a radially outer surface 184. When flare cone portion 78 is coupled to exit cone 92, radially inner flow surface 182 is substantially co-planar with exit cone flow surface 96. More specifically, flare cone inner flow surface 182 is divergent and extends from a stop surface 185 adjacent exit cone 92 to an elbow 186. Flare cone inner flow surface 182 extends radially outwardly from elbow 186 to a trailing end 188 of flare cone portion 78.

Flare cone outer surface 184 is substantially parallel to flare cone inner surface 182 between a leading edge 190 of flare cone portion 78 and elbow 186. Flare cone outer surface 184 is divergent and extends radially outwardly from elbow 186, such that outer surface 184 is substantially parallel to flare cone inner surface 182 between elbow 186 and flare cone trailing end 188. An alignment projection 192 extends radially outward from flare cone outer surface 184 between elbow 186 and flare cone trailing end 188. Alignment projection 192 includes a leading edge 194 that is substantially perpendicular with respect to combustor center longitudinal axis of symmetry 82, and a trailing edge 196 that extends downstream from an apex 198 of projection 192.

An attachment projection 200 extends a distance 202 axially upstream from flare cone stop surface 185. Projection 200 has a width 204 measured from a shoulder 206 created at the intersection of stop surface 185 and projection 200, and flare cone outer surface 184. Projection distance 202 and width 204 are each smaller than exit cone slot depth 172 and width 170, respectively. Accordingly, when flare cone portion 78 is coupled to exit cone 92, flare cone attachment projection 200 extends into exit cone slot 168. More specifically, as flare cone attachment projection 200 is extended into exit cone slot 168, exit cone aft end 162 contacts flare cone stop surface 185 to maintain flare cone leading edge 190 a distance 208 from a bottom surface 209 of exit cone slot 168. Accordingly, a cavity 210 is defined between flare cone attachment projection 200 and exit cone 92.

Combustor dome plate 74 secures dome assembly 70 in position within combustor 16. More specifically, combustor dome plate 74 includes an outer support plate 220 and an inner support plate 222. Plates 220 and 222 couple to respective combustor cowls 64 and 66 upstream from panels 58 to secure combustor dome assembly 70 within combustor 16. More specifically, plates 220 and 222 attach to annular deflector portion 76 which is coupled between plates 220 and 222, and flare cone portion 78.

Deflector portion 76 prevents hot combustion gases produced within combustor 16 from impinging upon the combustor dome plate 74, and includes a flange portion 230, an arcuate portion 232, and a body 234 extending therebetween. Flange portion 230 extends axially upstream from deflector body 234 to a deflector leading edge 236, and is substantially parallel with combustor center longitudinal axis of symmetry 82. More specifically, flange portion leading edge 236 is upstream from flare cone leading edge 194.

Deflector arcuate portion 232 extends radially outwardly and downstream from body 234 to a deflector trailing edge 242. More specifically, arcuate portion 232 extends from deflector body 234 in a direction that is generally parallel a direction flare cone portion 78 extends downstream from flare cone elbow 186. Furthermore, deflector arcuate portion trailing edge 242 is downstream from flare cone trailing edge 196.

Deflector body 234 has a generally planar inner surface 246 that extends from a forward surface 248 of deflector body 234 to a trailing surface 250 of deflector body 234. A corner 252 created between deflector body surfaces 246 and 250 is rounded, and trailing surface 250 extends between corner 252 and an aft attachment projection 260 extending radially outward from deflector body 234. Deflector aft projection 260 is attached against flare cone alignment projection leading edge 194, such that deflector body inner surface 246 is adjacent flare cone outer surface 184 between flare cone leading edge 190 and flare cone elbow 186.

Deflector portion 76 also includes a radially outer surface 270 and a radially inner surface 272. Radially outer surface 270 and radially inner surface 272 extend from deflector leading edge 236 across deflector body 234 to deflector trailing edge 242. A tape slot 274 extends a depth 276 radially into deflector body 234 from deflector outer surface 270, and extends axially for a width 280 measured between a leading and a trailing edge 282 and 284, respectively, of slot 274.

An opening 300 extends axially through deflector body 234. More specifically, opening 300 extends from an entrance 302 at deflector body inner surface 246 to an exit 304 at deflector trailing surface 250. Opening entrance 302 is radially inward from opening exit 304, which facilitates opening 300 discharging cooling fluid therethrough at a reduced pressure. In one embodiment, the cooling fluid is compressor air.

Opening 300 extends substantially circumferentially within deflector body 234 around combustor center longitudinal axis of symmetry 82, and separates deflector portion 76 into a radially outer portion and a radially inner or ligament portion. As cooling fluid is supplied through opening 300, the deflector ligament portion is thermally isolated.

During assembly of combustor 16, braze tape is preloaded into deflector tape slot 274, and braze rope is pre-loaded into air swirler exit cone wishbone joint slot 168. Deflector-flare cone assembly 75 is then tack-welded to combustor dome plate 220 to maintain combustor dome plate 220 and assembly 75 in proper axial placement and clocking during brazing. Accordingly, because braze tape and rope is preloaded, a single braze operation couples deflector-flare cone assembly 75 to air swirler flare cone 78 and combustor dome plate 220.

Furthermore, because deflector-flare cone assembly 75 is a one-piece assembly, deflector-flare cone assembly 75 facilitates performing visual inspections of brazes. More specifically, a braze joint 310 formed between deflector-flare cone assembly 75 and combustor dome plate 220 may be examined from a forward side of joint 310. Furthermore, flare cone wishbone joint inner arm 164 includes a plurality of notches 312 which permit a braze joint 314 formed between flare cone portion 78 and air swirler exit cone 92 to be examined. As a result, if a repair is warranted, machining a single diameter uncouples air swirler 90 from deflector-flare cone assembly 75 without risk of damage to other components.

During operation, forward swirler vanes 134 swirl air in a first direction and aft swirler vanes 132 swirl air in a second direction opposite to the first direction. Fuel discharged from fuel injector 80 is injected into air swirler forward venturi 146 and is mixed with air being swirled by forward swirler vanes 134. This initial mixture of fuel and air is discharged aft from forward venturi 146 and is mixed with air swirled through aft swirler vanes 132. The fuel/air mixture is spread radially outwardly due to the centrifugal effects of forward and aft swirler vanes 134 and 132, respectively, and flows along flare cone flow surface 182 and deflector arcuate portion flow surface 272 at a relatively wide discharge spray angle.

Cooling fluid is supplied to deflector-flare cone assembly 75 through deflector opening 300. Opening 300 permits a continuous flow of cooling fluid to be discharged at a reduced pressure for impingement cooling of flare cone portion 184. The reduced pressure facilitates improved cooling and backflow margin for the impingement cooling of flare cone portion 184. Furthermore, the cooling fluid enhances convective heat transfer and facilitates reducing an operating temperature of flare cone portion 188. The reduced operating temperature facilitates extending a useful life of flare cone portion 188, while reducing a rate of oxidation formation of flare cone portion 188.

In addition, as the cooling fluid is discharged through deflector portion 76, deflector ligament portion 304 is thermally isolated, which enables air swirler 90 to remotely couple to deflector-flare cone assembly 75, rather than to combustor dome plate 74.

Furthermore, as cooling fluid is discharged through opening 300, deflector arcuate portion 232 is film cooled. More specifically, opening 300 supplies deflector arcuate portion inner surface 272 with film cooling. Because opening 300 extends circumferentially within deflector portion 76, film cooling is directed along deflector inner surface 272 circumferentially around flare cone portion 78. In addition, because opening 300 permits uniform cooling flow, deflector-flare cone assembly 75 facilitates optimizing film cooling while reducing mixing of the cooling fluid with combustion air, which thereby facilitates reducing an adverse effect of flare cooling on combustor emissions.

The above-described combustor system for a gas turbine engine is cost-effective and reliable. The combustor system includes a one-piece diffuser-flare cone assembly that includes an integral cooling opening. Cooling fluid supplied through the opening provides impingement cooling of the flare cone portion of the diffuser-flare cone assembly, and film cooling of the deflector portion of the diffuser-flare cone assembly. Furthermore, because the opening extends circumferentially within the diffuser portion, a uniform flow of cooling fluid is supplied circumferentially that facilitates reducing an operating temperature of the deflector-flare cone assembly. As a result, the deflector-flare cone assembly facilitates extending a useful life of the combustor in a reliable and cost-effective manner.

While the invention has been described in terms of various specific embodiments, those skilled in the art will recognize that the invention can be practiced with modification within the spirit and scope of the claims.

What is claimed is:

1. A method for operating a gas turbine engine including a combustor, the combustor having a centerline axis and including an air swirler and a dome assembly circumferentially around the air swirler, and including an integral slot extending substantially circumferentially around and angled with respect to the centerline axis, said method comprising the steps of:

supplying fuel to the combustor through the air swirler;

directing cooling fluid substantially circumferentially and radially outwardly through the dome assembly slot for film cooling at least a portion of the dome assembly.

2. A method in accordance with claim 1 wherein the combustor dome assembly includes an integral flare cone and a deflector, the slot defined within the deflector, said step of directing cooling fluid substantially circumferentially further comprises film cooling the dome assembly deflector.

3. A method in accordance with claim 2 wherein said step of directing cooling fluid substantially circumferentially further comprises the step of directing cooling fluid through the deflector slot to facilitate reducing mixing downstream from the deflector slot between cooling fluid and combustion gases flowing through the combustor.

4. A method in accordance with claim 2 wherein said step of directing cooling fluid substantially circumferentially further comprises directing cooling fluid substantially circumferentially through the deflector slot to reduce an operating temperature of the dome assembly to facilitate extending a useful life of the combustor.

5. A method in accordance with claim 2 wherein step of directing cooling fluid substantially circumferentially further comprises directing cooling fluid substantially circumferentially through the deflector slot to facilitate reducing a rate of oxidation formation within the combustor dome assembly.

6. A combustor for a gas turbine engine, said combustor having a centerline axis and comprising:

an air swirler; and a dome assembly circumferentially around said air swirler, said dome assembly comprising an integral slot extending substantially around and angled with respect to the centerline axis, said slot positioned such that cooling fluid is discharged radially outwardly therefrom for film cooling at least a portion of said dome assembly, said slot extending substantially circumferentially within said dome assembly.

7. A combustor in accordance with claim 6 wherein said dome assembly further comprises an integral flare cone and a deflector, at least one of said flare cone and said deflector in flow communication with said slot.

8. A combustor in accordance with claim 7 wherein said slot is defined by said deflector.

9. A combustor in accordance with claim 8 wherein said slot is further positioned such that cooling fluid discharged radially outwardly therefrom facilitates film cooling of said dome assembly deflector.

10. A combustor in accordance with claim 8 wherein said slot is further configured to facilitate reducing mixing between cooling fluid and combustion gases downstream from said slot.

11. A combustor in accordance with claim 8 wherein said slot is further configured to facilitate extending a useful life of said combustor.

12. A combustor in accordance with claim 8 wherein said slot is further configured to facilitate reducing a rate of oxidation formation within said dome assembly flare cone.

13. A gas turbine engine comprising a combustor having a centerline axis and comprising an air swirler and a dome assembly, said dome assembly configured to secure said air swirler within said combustor, said air swirler within said dome assembly, at least one of said dome assembly and said air swirler comprising a slot extending substantially around and angled with respect to the centerline axis, said slot positioned such that cooling fluid is discharged radially outwardly therefrom for film cooling at least a portion of said dome assembly.

14. A gas turbine engine in accordance with claim 13 wherein said combustor slot extends substantially circumferentially within said combustor.

15. A gas turbine engine in accordance with claim 14 wherein said combustor dome assembly further comprises an integral flare cone and a deflector, at least one of said flare cone and said deflector in flow communication with said combustor slot.

16. A gas turbine engine in accordance with claim 15 wherein said combustor slot is defined by said combustor dome assembly deflector.

17. A gas turbine engine in accordance with claim 16 wherein said combustor slot is further positioned such that cooling fluid discharged radially outwardly therefrom facilitates film cooling of said combustor dome assembly deflector.

18. A gas turbine engine in accordance with claim 17 wherein said combustor slot is further configured to facilitate reducing mixing between cooling fluid and combustion gases downstream from said slot.

19. A gas turbine engine in accordance with claim 17 wherein said combustor slot is further configured to facilitate extending a useful life of said combustor.

20. A combustor in accordance with claim 17 wherein said combustor slot is further configured to facilitate reducing a rate of oxidation formation within said combustor dome assembly.

* * * * *